United States Patent [19]

Anthony et al.

[11] 4,209,059

[45] * Jun. 24, 1980

[54] CREVICE-CORROSION RESISTANT ALUMINUM RADIATOR TRICLAD COMPOSITE

[75] Inventors: William H. Anthony, Manchester, Mo.; James M. Popplewell, Guilford, Conn.

[73] Assignee: Swiss Aluminium Ltd., Chippis, Switzerland

[ * ] Notice: The portion of the term of this patent subsequent to Apr. 22, 1992, has been disclaimed.

[21] Appl. No.: 968,290

[22] Filed: Dec. 11, 1978

[51] Int. Cl.[2] ..... F28F 19/06

[52] U.S. Cl. ..... 165/1; 165/133; 165/134 R; 165/180; 165/DIG. 8; 428/933

[58] Field of Search ..... 165/134, 173, 175, 180, 165/DIG. 8, 1, 133; 428/933

[56] References Cited

U.S. PATENT DOCUMENTS

| | | | |
|---|---|---|---|
| 2,618,846 | 11/1952 | Morris et al. | 165/134 |
| 3,053,511 | 9/1962 | Godfrey | 165/180 |
| 3,878,871 | 4/1975 | Anthony et al. | 138/140 |
| 3,960,208 | 6/1976 | Anthony et al. | 165/133 |
| 4,041,594 | 8/1977 | Chartet | 29/157.3 C |

FOREIGN PATENT DOCUMENTS

| | | | |
|---|---|---|---|
| 431520 | 7/1935 | United Kingdom | 165/DIG. 8 |
| 974590 | 11/1964 | United Kingdom | 165/134 |

*Primary Examiner*—Sheldon Richter
*Attorney, Agent, or Firm*—Bachman and LaPointe

[57] ABSTRACT

A triclad composite aluminum article having increased resistance to crevice corrosion in aqueous environments is disclosed in which a brazing composite having an aluminum core clad on one side with an aluminum brazing alloy is provided on the other side with a sacrificial clad consisting essentially of from 0 to 0.1% magnesium, 0.8 to 1.2% manganese, 0 to 0.1% chromium, 0 to 0.05% silicon, 0 to 0.05% copper, 0.1 to 0.4% zinc, 0 to 0.1% titanium, 0 to 0.1% iron, balance essentially aluminum.

11 Claims, 8 Drawing Figures

24
16
22
10
14
12
14
34
20
32
22
30

CREVICE-CORROSION RESISTANT ALUMINUM RADIATOR TRICLAD COMPOSITE

BACKGROUND OF THE INVENTION

It is highly desirable to develop composite aluminum articles having improved resistance to erosion corrosion in aqueous environments due to the wide use of aluminum commercially in aqueous environments. For example, aluminum tubing used in heat exchangers such as aluminum radiators should have a high resistance to erosion corrosion damage by aqueous heat exchange fluid. A particularly suitable composite material is disclosed in U.S. Pat. No. 3,878,871 by the instant inventors and assigned to the assignee of the instant case wherein an aluminum core material consisting essentially of from 0.001 to 0.3% magnesium, 0.2 to 0.8% manganese, 0.001 to 0.1% chromium, 0.001 to 0.2% titanium, 0.05 to 0.5% silicon, 0.001 to 0.2% iron, 0.001 to 0.1% copper, and 0.001 to 0.1% zinc, balance aluminum is metallurgically bonded to an aluminum cladding material consisting essentially of from 0.001 to 0.1% magnesium, 0.8 to 1.2% manganese, 0.001 to 0.1% chromium, 0.001 to 0.1% titanium, 0.001 to 0.05% silicon, 0.001 to 0.05% copper, 0.1 to 0.4% zinc, and 0.001 to 0.1% iron, balance aluminum.

Presently, automobile manufacturers are actively working to substitute aluminum and plastic for brass in various parts of an automobile radiator as a cost and weight saving measure. In some cases, the radiator design calls for a plastic tank to be attached to an aluminum tube assembly so as to form a header. An O-ring gasket is provided between the plastic tank and an aluminum header plate of the aluminum tube assembly so as to provide a leak-free joint. Heretofore, such a design suffered from a distinct disadvantage in that severe crevice corrosion occurred in the groove surface of the aluminum header plate into which the O-ring sealing gasket fits. The crevice corrosion observed was so severe that leakage failures of the radiators occurred in a short time.

In an effort to overcome the above-noted problem, manufacturers provided the aluminum header plate with a sacrificial cladding layer of aluminum alloy 7072. While some improvement in crevice corrosion was observed, it was found that the 7072 alloy dissolved extremely fast and severe crevice corrosion occurred.

Accordingly, it is a principal object of the present invention to provide a triclad aluminum composite having a sacrificial layer which has improved resistance to crevice corrosion in an aqueous environment.

It is a further object of the present invention to provide a triclad aluminum composite particularly suitable as an aluminum header plate in an automobile radiator.

It is still a further object of the present invention to provide an aluminum header plate composed of a triclad composite having a sacrificial clad layer and a brazing clad layer.

Further objects and advantages of the present invention will appear hereinbelow.

SUMMARY OF THE INVENTION

In accordance with the present invention, it has been found that the foregoing objects and advantages may be readily obtained.

The triclad aluminum composite and articles made therefrom has improved crevice corrosion properties in aqueous environments. The triclad composite comprises an aluminum alloy core element selected from conventional brazing alloy core elements such as 3003, 3004, 3005, 5052 and 6951. A preferred core alloy employed in the triclad composite of the present invention is 6951 alloy containing additions of chromium in the range of from about 0.1 to 0.4%, preferably 0.2 to 0.35%. The nominal composition for aluminum alloy 6951 is 0.2 to 0.5% silicon, 0 to 0.8% iron, 0.1 to 0.4% copper, 0 to 0.1% manganese, 0.4 to 0.8% magnesium, 0 to 0.2% zinc, balance essentially aluminum. Metallurgically bonded to one side of the core alloy is a brazing alloy selected from known aluminum silicon brazing alloys such as vaccuum brazing alloy 4004, flux brazing alloy 4343 or Al, Si, Mg, Bi brazing alloy comprising modified 4104 having the composition 9.0 to 10.5% silicon, 0 to 0.8% iron, 0 to 0.25% copper, 0 to 0.1% manganese, 1.0 to 2.0% magnesium, 0 to 0.2% zinc, 0.02 to 0.2% bismuth, balance essentially aluminum. The choice of brazing alloy depends on softening temperature range of core alloy and whether there is a need to getter out oxygen from a vacuum or inert gas medium. Al, Si alloys provide the various brazing ranges required by varying the Si content. Where gettering action is needed Mg, Bi are added as in the modified 4104. A sacrificial cladding layer consisting essentially of from 0 to 0.3% magnesium, 0.2 to 0.8% manganese, 0 to 0.1% chromium, 0 to 0.1% titanium, 0 to 0.05% silicon, 0 to 0.05% copper, 0.1 to 0.4% zinc, and 0 to 0.1% iron, balance aluminum is metallurgically bonded to the other side of the core alloy.

The present invention contemplates a triclad composite aluminum header plate, tubing and heat exchanger assembly having improved resistance to erosion corrosion and crevice corrosion in an aqueous environment. The assembly comprises at least one header plate connected on one side by at least one tube having a secondary heat exchange surface connected to said tube and a plastic tank connected to the other side of the header plate and having an O-ring seal to provide a leak-free joint between the tank and the header plate. The header plate and tube is formed of the improved aluminum triclad composite of the present invention. The preferred embodiment includes two parallel header plates each provided with a plastic tank connected thereto so as to form a pair of header assemblies connected by a plurality of tubes perpendicular therewith, with corrugated fin stock material being bonded to said tube.

The present invention also contemplates an improved heat transfer system and a process for providing heat transfer with resistance to crevice corrosion in an aqueous environment. The process comprises providing a pair of parallel header plates, securing a plastic tank to one side of each of the header plates by means of an O-ring gasket leak-free joint so as to form a first and second header, affixing tubes to the other sides of the header plates and passing the aqueous liquid from said first header through said tubes to said second header.

DETAILED DESCRIPTION

The triclad composite aluminum article of the present invention comprises an aluminum core material having an aluminum brazing alloy metallurgically bonded to one side thereof and the preferred aluminum sacrificial layer metallurgically bonded to the other side thereof. The sacrificial layer comprises an aluminum alloy consisting essentially of from 0 to 0.1%, preferably 0 to 0.05% magnesium; 0.8 to 1.2%, preferably 0.9 to 1.1% manganese; 0 to 0.1%, preferably 0 to 0.05% chromium; 0 to 0.05%, preferably 0 to 0.03% silicon; 0 to 0.05%, preferably 0 to 0.01% copper; 0.1 to 0.4%, preferably 0.15 to 0.25% zinc; 0 to 0.1%, preferably 0.005 to 0.03% titanium; 0 to 0.1%, preferably 0 to 0.08% iron; balance essentially aluminum.

The essential constituents of the sacrificial layer are manganese and zinc. The remaining elements may be present as impurities up to the levels listed above without greatly adversely effecting the properties of the sacrificial alloy. Naturally, any of the foregoing impurities may be present in levels as low as 0.001%.

The aluminum core alloy element may be a conventional aluminum core alloy such as 3003, 3004, 3005, 5052 or 6951. The preferred core alloy of the present invention is a modified 6951 alloy containing a chromium addition in the amount of from about 0.1 to 0.4%, preferably 0.2 to 0.35%. The brazing clad alloy may be a conventional brazing alloy such as vacuum brazing alloy 4004, flux brazing alloy 4343 or Al, Si, Mg, Bi brazing alloy modified 4104.

The excellent crevice corrosion resistance of the composite of the present invention is highly desirable commercially. This property admirably lends the triclad composite of the present invention to use in heat exchange assemblies such as in aluminum radiators wherein the composite is used as the header plates and tubes. The surprising properties achieved in accordance with the present invention would give the material of the present invention good utility in other applications using aqueous fluids.

The thickness of the sacrificial layer and the brazing layer generally is each between 2 and 20% of the total thickness of the composite and preferably between 5 and 15%. The thickness of the core may be established on the basis of mechanical properties which the finished item must possess. In general, the thickness of the sacrificial layer and the brazing layer will each range from 0.001 to 0.100 inches.

If the composite is produced in the form of sheet from which the header plates and tubes are fabricated for heat exchange purposes, the composite will have a thickness of from 0.010 to 0.10 and the sacrificial layer brazing layer will have a thickness of from 0.001 to 0.020 inches. The material of the present invention may be fabricated into other objects such as fins on heat exchangers.

Figures 1, 2, 3:
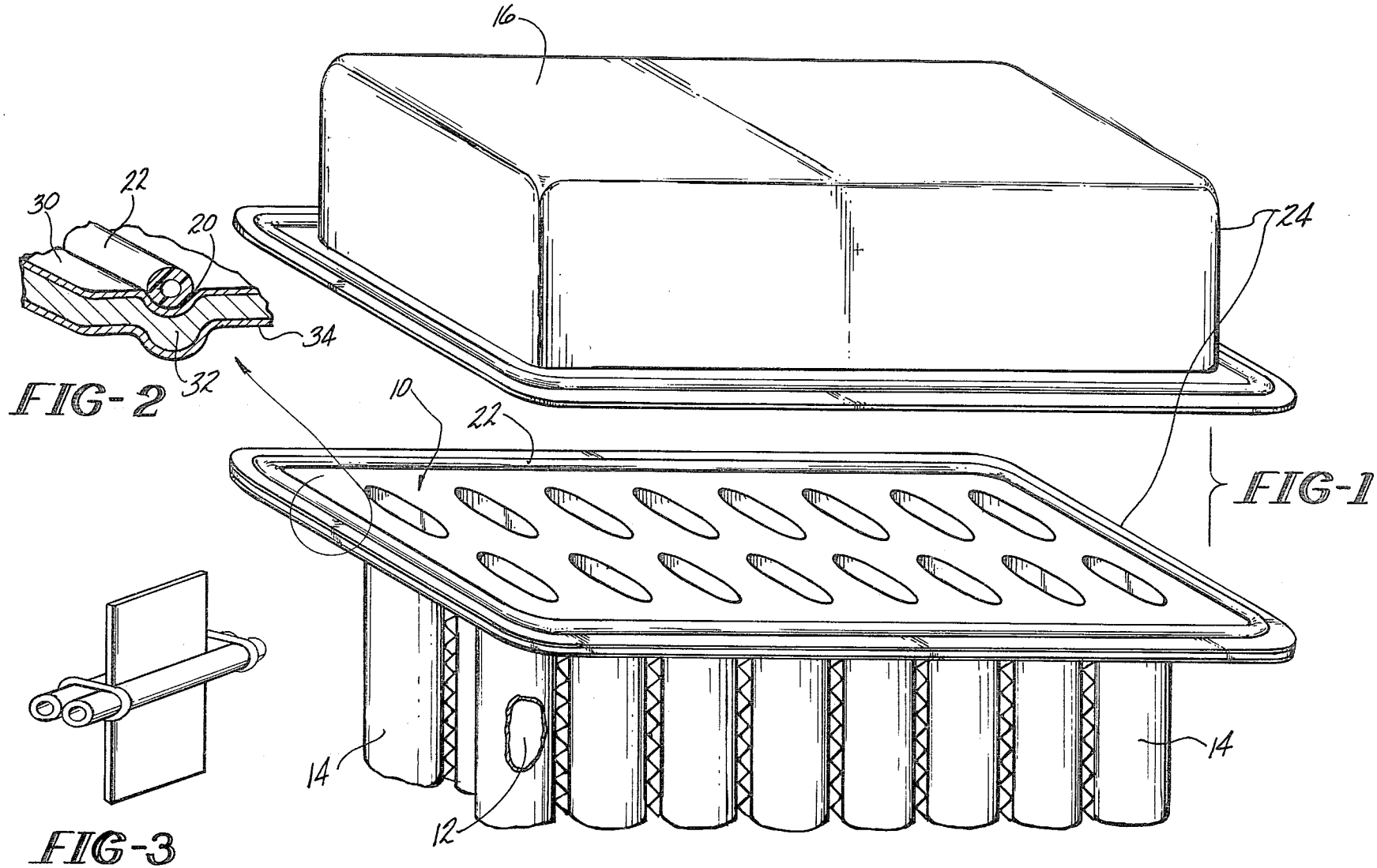
FIG. 1 is a perspective exploded view, with portions cut away, of an automobile radiator including the triclad aluminum composite header plate and tubing of the present invention.
FIG. 2 is a perspective sectional view of the header plate of the present invention.
FIG. 3 is an illustration of a typical test specimen used in testing the crevice corrosion properties of various composites.
Figure 4A:
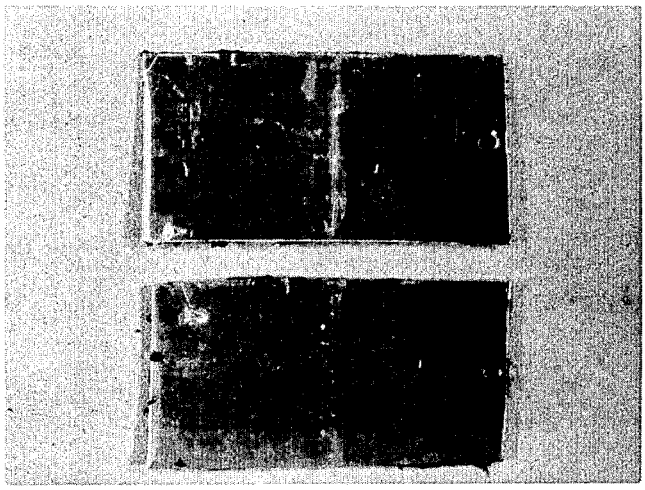
FIGS. 4A, 4B, 4C, 4D and 4E are photomicrographs illustrating the crevice corrosion of various specimens tested in an automobile radiator environment.
Figure 4B:
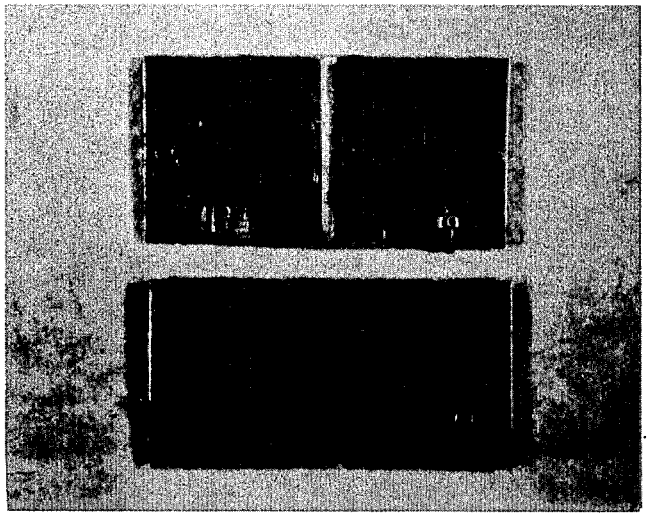
Figure 4C:
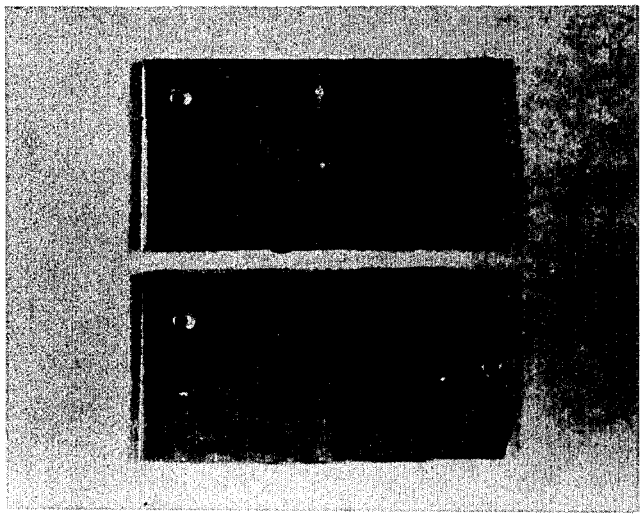
Figure 4D:
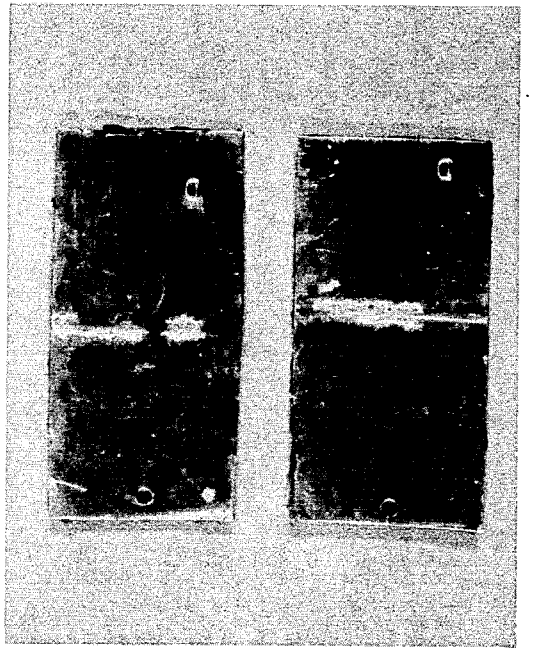
Figure 4E:
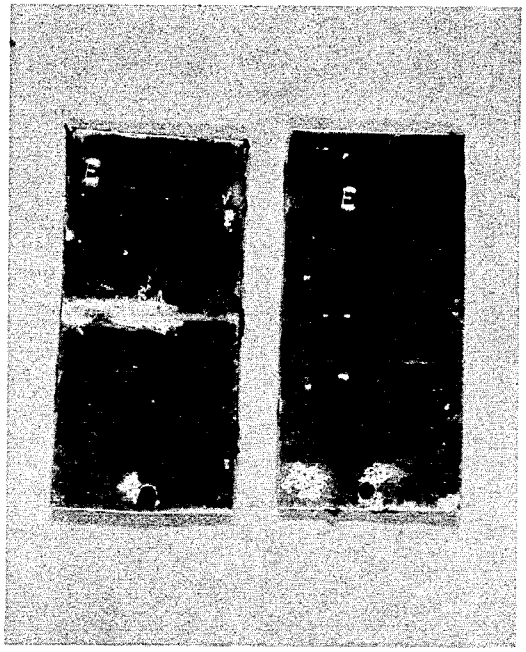

With reference to FIG. 1, it has been found that in aqueous environments crevice and erosion corrosion occurs, as for example, upon the surface of the header plate 10 and the inside wall 12 of the tubes 14. In particular, in the specific automobile radiator design shown in FIG. 1 wherein a plastic tank 16 is secured to the header plate 10 so as to form a header, extreme crevice corrosion occurs in the groove surface 20 of the aluminum header plate 10 in which an O-ring gasket 22 fits so as to provide a leak-free seal between the header plate 10 and plastic plate 16.

Thus, in accordance with the present invention and as can best be seen in FIG. 2, the high strength heat exchanger of the present invention is fabricated from an aluminum triclad composite wherein the particular aluminum alloy sacrificial layer 30 of the present invention is metallurgically bonded to a core layer 32 which has a brazing alloy layer 34 bonded to the other side thereof. The connecting tubes of the radiator assembly may be fabricated from the same triclad composite wherein the sacrificial layer is contacted by the aqueous environment, the tubes 14 being brazed to the header plate 10. In addition, corrugated fins 18 made from any suitable brazing alloy may be provided between the tubes 14 and extending from the inlet header assembly 24 and the outlet header assembly (not shown).

The present invention will be more readily apparent from a consideration of the following illustrative examples.

EXAMPLE I

Five alloys, Alloys A, B, C, D and E, were prepared as sheet materials by conventional casting and rolling practices. The composition and final gage thickness of the alloys are shown in Table I below.

TABLE I

| Alloy No. | Alloy Type | Gage | Percentage Composition | | | | | | | |
|---|---|---|---|---|---|---|---|---|---|---|
| | | | Si | Mn | Fe | Cu | Mg | Ti | Cr | Zn |
| A | Present Invention | .00135 | .035 | 1.07 | .070 | >.01 | >.01 | .014 | >.02 | +168 |
| B | 6951 + Cr | .01530 | .52 | .067 | .39 | .235 | .54 | .010 | .243 | .105 |
| C | 6951 | .01530 | .52 | .067 | .39 | .235 | .54 | .01 | — | .107 |
| D | 3003 | .01530 | .2 | 1.0 | .55 | .25 | — | .01 | — | — |
| E | 7072 | .00135 | .35 | — | .40 | .1 | .1 | — | — | 1.0 |

The samples were put through a simulated brazing cycle by heating them to 1075° F. for four minutes.

In order to demonstrate the galvanic protection the sacrificial alloy of the present invention offers compared with 7072, flag shaped specimens of these alloys were cut and the specimens were then coupled together through a standard 10 Ohm resistor to form the five sample couples listed in Table II below:

TABLE II

Protective Behavior of Test Couples in a Simulated Antifreeze Environment

| Sample Couple | Direction | Maximum Current Density Microamperes per Square cm 1st Cycle | 2nd Cycle | 3rd Cycle |
|---|---|---|---|---|
| A protecting B | A protective | 8 at 105° C. | 6 at 105° C. | 5 at 105° C. |
| | A nonprotective | .4 at 40° C. | no nonprotective current | |
| A protecting C | A protective | 2.8 at 105° C. | 4.0 at 105° C. | 2.8 at 105° C. |
| | A nonprotective | ← no nonprotective current → | | |
| A protecting D | A protective | 2.2 at 105° C. | 1.75 at 105° C. | 3.5 at 105° C. |
| | A nonprotective | .7 at 60° C. | .6 at 60° C. | .2 at 60° C. |
| E protecting C | E protective | 2.3 at 105° C. | 3.2 at 105° C. | 4.0 at 60° C. |
| | E nonprotective | ← no nonprotective current → | | |
| E protecting D | E protective | 1.5 at 95° C. | 1.0 at 100° C. | 1.0 at 100° C. |
| | E nonprotective | 3 at 105° C. | 1 at 105° C. | .5 at 105° C. |

The sample couples were immersed in a test solution equivalent to aqueous antifreeze material typically found in car radiators and consisting of 50% ethylene glycol, 0.005 M $B_4O_7^{=}$ as borax, 0.02 M $PO_4^{=}$ as sodium phosphate, 500 ppm $Cl^-$ as NaCl balance distilled water. Leads were connected from both sides of the 10 Ohm resistor to the poles of a Keithley Nanovoltmeter capable of measuring small currents. The temperature of the test solution was then cycled three times from ambient temperature to 105° C. simulating the temperature in a car radiator as the vehicle is used and subsequently stopped for overnight parking. Table II above shows the maximum current densities in the protective and nonprotective directions for these three cycles for the sample couples tested.

As can be seen from the data presented in Table II, the sacrificial alloy of the present invention, A, protects the core material C as well as the normally used sacrificial alloy E which, as noted above, exhibits severe crevice corrosion. The data illustrated in Table II also indicates that the core alloy B is substantially protected by the sacrificial alloy of the present invention. In addition, the data shows that the sacrificial alloy A of the present invention protects core alloy D better than the standard sacrificial alloy E as evidenced by the strong nonprotective current which is not present in the A–D couple.

EXAMPLE II

Using the alloys as prepared in Example I above, two sided composites of alloy A on alloy B and alloy A on alloy D were fabricated by conventional rolling and cladding practice. The final temper of the composites was H 14 and the cladding thickness on each side of the core was 7.5% of the total composite thickness. A similar two sided clad composite of alloy A on a new alloy F, the composition and final gage thickness of which is set forth in Table III below, was prepared.

TABLE III

| Alloy No. | Gage | Percentage Composition of F Alloy Si | Mn | Fe | Cu | Mg | Ti | Cr | Zn | Zr |
|---|---|---|---|---|---|---|---|---|---|---|
| F | .01530 | .2 | 1.0 | .35 | .2 | — | .01 | .20 | — | .15 |

Two control composites were fabricated, a triclad composite consisting of a core of alloy C clad on one side with brazing alloy 4004 and on the other side with alloy E and a final composite consisting of alloy D clad with brazing alloy 4004. All five specimens were subjected to a simulated inert gas brazing cycle consisting of heating the materials in air to 1075° F. for four minutes and then allowed to cool to room temperature.

The brazing alloy side of each of the control specimens was then coated with bathtub silicone rubber cement. The rubber cement coating prevents unwanted galvanic effects from the brazing alloy clad. The same coating was also applied to the triclad specimens in which alloy A, the alloy of the present invention, was clad.

In order to simulate the joint which occurs in the radiator disclosed above in which a plastic tank is secured to an aluminum header plate, glass rods were pushed into gum rubber tubing and the pieces of rubber tubing were secured to either side of each of the composite specimens by means of O-rings as can be seen in FIG. 3. Duplicate specimens of each composite were made.

All of the specimens were suspended for thirty days in an aqueous antifreeze test solution identical to that used in Example I above. The temperature of the solution was cycled each day from room temperature to 93° C. where the temperature was held constant for two hours. The heat up time of the solution was two hours. After the 30 day test period was over, the composite samples were removed from the test solution and cleaned with a hot mixture of chromic acid and ortho phosphoric acid so as to remove any corrosion products. The samples were then examined so as to determine their resistance to crevice corrosion.

FIGS. 4A, 4B, 4C, 4D and 4E are photographs of the surfaces of A on B, A on D, A on F, E on C and D side of D clad with brazing alloy 4004. As is evident from FIGS. 4A through 4E, there is very little crevice corrosion on any of the three clad composites clad with alloy A, the sacrificial alloy of the present invention, while both the sacrificial alloy heretofore employed, alloy E, and alloy D evidence severe crevice corrosion. Measurements were taken to determine the maximum depth of pitting on each of the specimens and the results are listed below in Table IV.

TABLE IV

| Test Material | Maximum Depth (microns) |
|---|---|
| A on B | zero |
| A on D | zero |
| A on F | zero |
| E on C | 60 microns |
| 3003 bare | 30 microns |

Thus, it is evident from the test presented hereinabove that the sacrificial alloy of the present invention is a superior sacrificial alloy for use in automobile radiators than those alloys heretofore known.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A triclad composite metal article having improved resistance to crevice corrosion in aqueous environments comprising an aluminum core, an aluminum brazing alloy metallurgically bonded to said core and a sacrificial aluminum cladding bonded to the other side of said core, said sacrificial alloy cladding consisting essentially of from 0 to 0.1% magnesium, 0.8 to 1.2% manganese, 0 to 0.1% chromium, 0 to 0.05% silicon, 0 to 0.05% copper, 0.1 to 0.4% zinc, 0 to 0.1% titanium, 0 to 0.1% iron, balance essentially aluminum.

2. A triclad composite metal article according to claim 1 wherein said cladding consists essentially of from 0 to 0.05% magnesium, 0.9 to 1.1% manganese, 0 to 0.05% chromium, 0 to 0.03% silicon, 0 to 0.01% copper, 0.15 to 0.25% zinc, 0.005 to 0.03% titanium and 0 to 0.08% iron.

3. A process for providing heat transfer with resistance to crevice corrosion in an aqueous environment which comprises:

A. providing a metal header plate comprising an aluminum core, an aluminum brazing alloy metallurgically bonded to one side of said core and a sacrificial aluminum alloy cladding metallurgically bonded to the other side of said core, said sacrificial alloy cladding consisting essentially of from 0 to 0.1% magnesium, 0.8 to 1.2% manganese, 0 to 0.1% chromium, 0 to 0.05% silicon, 0 to 0.05% copper, 0.1 to 0.4% zinc, 0 to 0.1% titanium, 0 to 0.1% iron, balance essentially aluminum;

B. affixing metal tubes to the brazing alloy side of said metal header plate;

C. passing an aqueous liquid over said sacrificial alloy cladding and through said tubing; and D. contacting the external surface of said tubing with a secondary heat exchange surface.

4. A process according to claim 3 wherein said cladding consists essentially of from 0 to 0.05% magnesium, 0.9 to 1.1% manganese, 0 to 0.05% chromium, 0 to 0.03% silicon, 0 to 0.01% copper, 0.15 to 0.25% zinc, 0.005 to 0.03% titanium and 0 to 0.08% iron.

5. A process according to claim 3 wherein said second heat exchange surface is corrugated fin stock bonded to said tubing.

6. A process according to claim 3 including

E. providing said sacrificial alloy cladding with a groove;

F. positioning an O-ring gasket seal in said groove; and

G. securing a plastic tank to said header plate so as to form a header assembly wherein said gasket provides a leak-free joint wherein crevice corrosion in the area of said gasket is reduced.

7. A process according to claim 6 wherein said cladding consists essentially of from 0 to 0.05% magnesium, 0.9 to 1.1% manganese, 0 to 0.05% chromium, 0 to 0.03% silicon, 0 to 0.01% copper, 0.15 to 0.25% zinc, 0.005 to 0.03% titanium and 0 to 0.08% iron.

8. An aluminum heat exchange assembly having improved resistance to crevice corrosion in aqueous environments comprising:

A. at least one header plate;

B. at least one tube connected to said header plate; and

C. a second heat exchange surface connected to said tube wherein said header plate comprises an aluminum triclad composite having a core, a brazing alloy metallurgically bonded to one side of said core and an aluminum alloy sacrificial cladding metallurgically bonded to the other side of said core, said alloy cladding consisting essentially of from 0 to 0.1% magnesium, 0.8 to 1.2% manganese, 0 to 0.1% chromium, 0 to 0.05% silicon, 0 to 0.05% copper, 0.1 to 0.4% zinc, 0 to 0.1% titanium, 0 to 0.1% iron, balance essentially aluminum.

9. An assembly according to claim 8 wherein said cladding consists essentially of from 0 to 0.05% magnesium, 0.9 to 1.1% manganese, 0 to 0.05% chromium, 0 to 0.03% silicon, 0 to 0.01% copper, 0.15 to 0.25% zinc, 0.005 to 0.03% titanium and 0 to 0.08% iron.

10. An assembly according to claim 8 further including a plastic tank secured to said header plate and sealing means provided between said tank and said sacrificial alloy of said header plate so as to provide a leak-free joint.

11. An assembly according to claim 10 wherein said cladding consists essentially of from 0 to 0.05% magnesium, 0.9 to 1.1% manganese, 0 to 0.05% chromium, 0 to 0.03% silicon, 0 to 0.01% copper, 0.15 to 0.25% zinc, 0.005 to 0.03% titanium and 0 to 0.08% iron.

* * * * *